US009913518B2

(12) United States Patent
Su

(10) Patent No.: US 9,913,518 B2
(45) Date of Patent: Mar. 13, 2018

(54) INNER LINING AND WATERPROOF BAG HAVING SAME

(71) Applicant: Jung-Yuan Su, Taipei (TW)

(72) Inventor: Jung-Yuan Su, Taipei (TW)

( * ) Notice: Subject to any disclaimer, the term of this patent is extended or adjusted under 35 U.S.C. 154(b) by 130 days.

(21) Appl. No.: 14/970,272

(22) Filed: Dec. 15, 2015

(65) Prior Publication Data

US 2016/0316876 A1 Nov. 3, 2016

(30) Foreign Application Priority Data

Apr. 28, 2015 (TW) ..... 104206473 U

(51) Int. Cl.

| | |
|---|---|
| ***A45C 1/02*** | (2006.01) |
| ***A45C 13/02*** | (2006.01) |
| ***A45F 3/04*** | (2006.01) |
| ***A45C 3/00*** | (2006.01) |
| ***A45C 13/00*** | (2006.01) |
| ***A45C 3/06*** | (2006.01) |
| ***A45C 13/30*** | (2006.01) |

(52) U.S. Cl.

CPC ..... *A45C 13/02* (2013.01); *A45C 3/001* (2013.01); *A45C 3/06* (2013.01); *A45C 13/008* (2013.01); *A45C 13/30* (2013.01); *A45F 3/04* (2013.01)

(58) Field of Classification Search

CPC .. A45C 3/06; A45C 13/26; A45C 3/00; A45C 13/18; A45C 9/00

USPC ..... 150/110, 107, 100, 18 A; 206/579, 548, 206/581, 8; 383/108, 112, 121

See application file for complete search history.

(56) References Cited

U.S. PATENT DOCUMENTS 1,827,111 A * 10/1931 Rowe ..... B65D 31/16 217/3 CB
1,853,013 A * 4/1932 Brady ..... B65D 29/00 383/117
1,935,612 A * 11/1933 Brady ..... B65D 29/02 383/108
3,197,119 A * 7/1965 Hartig ..... B65D 31/147 383/116

(Continued)

FOREIGN PATENT DOCUMENTS

JP 2009183849 A 8/2009
KR 1020060000475 1/2006

(Continued)

*Primary Examiner* — Fenn C Mathew
*Assistant Examiner* — Cynthia Collado
(74) *Attorney, Agent, or Firm* — Ming Chow; Sinorica, LLC

(57) ABSTRACT

Provided is an inner lining for backpacks or handbags. The inner lining has a receiving space constructed by folding and stitching at least one waterproof fabric. Multiple seam lines on the inner lining are covered by waterproof tapes. The inner lining may prevent the rainwater permeating into the receiving space through the seam lines. Items may be protected from the wet in the receiving space of the inner lining. Further provided is a waterproof bag having the inner lining. The inner lining is sewed in an outer bag to construct the waterproof bag. Multiple seam lines between the outer bag and the inner lining are also covered by waterproof tapes. The inner lining and the waterproof bag having the inner lining provide more convenience and safety for users in rainy days.

4 Claims, 4 Drawing Sheets

(56) References Cited

U.S. PATENT DOCUMENTS

| | | | | | |
|---|---|---|---|---|---|
| 3,337,118 | A * | 8/1967 | Friduss | ..... | B65D 33/26<br>383/211 |
| 4,877,281 | A * | 10/1989 | Altmann | ..... | B60R 5/04<br>220/495.01 |
| 7,153,025 | B1 * | 12/2006 | Jackson | ..... | A45C 7/0059<br>224/246 |

FOREIGN PATENT DOCUMENTS

| | | |
|---|---|---|
| KR | 2020080000550 | 4/2008 |
| KR | 2004513470000 | 12/2010 |

* cited by examiner

INNER LINING AND WATERPROOF BAG HAVING SAME

The current application claims a foreign priority to application number 104206473 filed on Apr. 28, 2015 in Taiwan.

BACKGROUND OF THE INVENTION

1. Field of the Invention

The present invention relates to an inner lining for backpacks or handbags, and more particularly to an inner lining that has a waterproof function. In addition, a waterproof bag may be manufactured by mounting the inner lining in an outer bag.

2. Description of the Related Art

Conventional waterproof protective bags are made of waterproof fabrics and therefore considered to be waterproof. The conventional bags are made of stitched waterproof fabrics or a folded and stitched fabric. Stitches for joining the edges of the fabric leave multiple sewing holes along the seam lines. The sewing holes, specifically in a heavy rain, permit rainwater into the conventional waterproof protective bags and bleach the declared waterproofing functionality. In other words, the conventional waterproof bags may at most be referred to as water repellent, instead of waterproof bags.

Conventional means to meet the abovementioned problem was to further purchase a rain cover for a conventional waterproof bag to prevent rainwater from entering the bag through the sewing holes, and therefore prevent items held in the bag from being ruined by penetrating rainwater. There are many inconveniences for user such as forgetting to bring the rain cover in rainy days. Furthermore, the rain cover is very light and thin, subject to frictional damage. Even a gust of wind may easily carry away the rain cover. The rain cover is thus barely an effective means for the conventional waterproof bag to preserve waterproof functionality against rainwater.

SUMMARY OF THE INVENTION

An objective of the present invention is to provide an inner lining for a bag and a waterproof bag having the inner lining. The inner lining may prevent the rainwater permeating into the bag and provide the protection for the items in the bag. In addition, users do not worry about forgetting to bring the conventional waterproof bag cover if it rains suddenly. The inner lining and the waterproof bag having the inner lining help users to walk at streets and carry the bags with ease and comfort in rainy days.

To achieve the foregoing objective, the inner lining comprises: at least one waterproof fabric and at least one waterproof tape. The at least one waterproof fabric is folded and stitched. A receiving space is formed by the at least one waterproof fabric. The at least one waterproof fabric further includes an overlapping portion, at least one seam line, and multiple gaps. The overlapping portion is formed around the at least one waterproof fabric. The at least one seam line is sewed on the overlapping portion. The multiple gaps are between the overlapping portion and the at least one seam line. The at least one waterproof tape covers the at least one seam line and seals the multiple gaps.

The advantage of the present invention is that the receiving space is constructed by folding and stitching the at least one waterproof fabric. The multiple gaps between the overlapping portion and the at least one seam line are covered and sealed by the at least one waterproof tape. This arrangement may prevent the rainwater permeating into the receiving space through the at least one seam line. Items may be protected from the wet in the receiving space.

Particularly, an inner pocket is sewed on the at least one waterproof fabric within the receiving space. The inner pocket has multiple pocket seam lines between the at least one waterproof fabric and the inner pocket. The at least one waterproof tape covers the multiple pocket seam lines. The advantage of the present invention is that the receiving space may be divided into compartments by sewing the inner pocket in the receiving space. It is convenient for user to store items neatly. The gaps between the at least one waterproof fabric and the multiple pocket seam lines are covered and sealed by the at least one waterproof tape. This arrangement may also prevent the rainwater permeating into the receiving space through the multiple pocket seam lines.

More particularly, a fixer is sewed on the at least one waterproof fabric within the receiving space. The fixer is selectively fixed with the inner pocket. The fixer has multiple fixing seam lines between the at least one waterproof fabric and the fixer. The at least one waterproof tape covers the multiple fixing seam lines. The advantage of the present invention is that an opening of the inner pocket may be closed by the fixer selectively. Items in the inner pocket do not come out if the inner lining is dumped. Furthermore, the multiple gaps between the at least one waterproof fabric and the multiple fixing seam lines are covered and sealed by the at least one waterproof tape. This arrangement may also prevent the rainwater permeating into the receiving space through the multiple fixing seam lines in rainy days.

The present invention further provides a waterproof bag having said inner lining. The waterproof bag comprises: an outer bag, a cap, an interval space, and a portable device. The outer bag has an accommodating space, and the inner lining is sewed in the accommodating space. The cap is mounted to a top of the outer bag, and the accommodating space is selectively closed by the cap. The interval space is formed between the outer bag and the inner lining. The portable device is mounted on the outer bag.

The advantage of the present invention is enhancing the waterproof efficacy for the waterproof bag by sewing the inner lining in the outer bag. In addition, the connecting portion between the inner lining and the outer bag may be covered by the cap. The rainwater may not permeate into the interval space through the connecting portion.

Particularly, the portable device is a pair of shoulder straps or a hand strap. The hand strap is mounted on the cap. The advantage of the present invention is that the waterproof bag may be carried selectively on the shoulders or by hand. It is convenient for users to take the waterproof bag around.

More particularly, at least one leaking hole is formed on a bottom of the outer bag. The at least one leaking hole connects the interval space and an exterior of the outer bag. The advantage of the present invention is that the rainwater may drain away to the exterior of the outer bag through the at least one leaking hole if the rainwater permeates into the interval space accidentally. The interval space may keep dry and avoid inducing mildews by moistures.

DETAILED DESCRIPTION OF THE INVENTION

Figure 1:
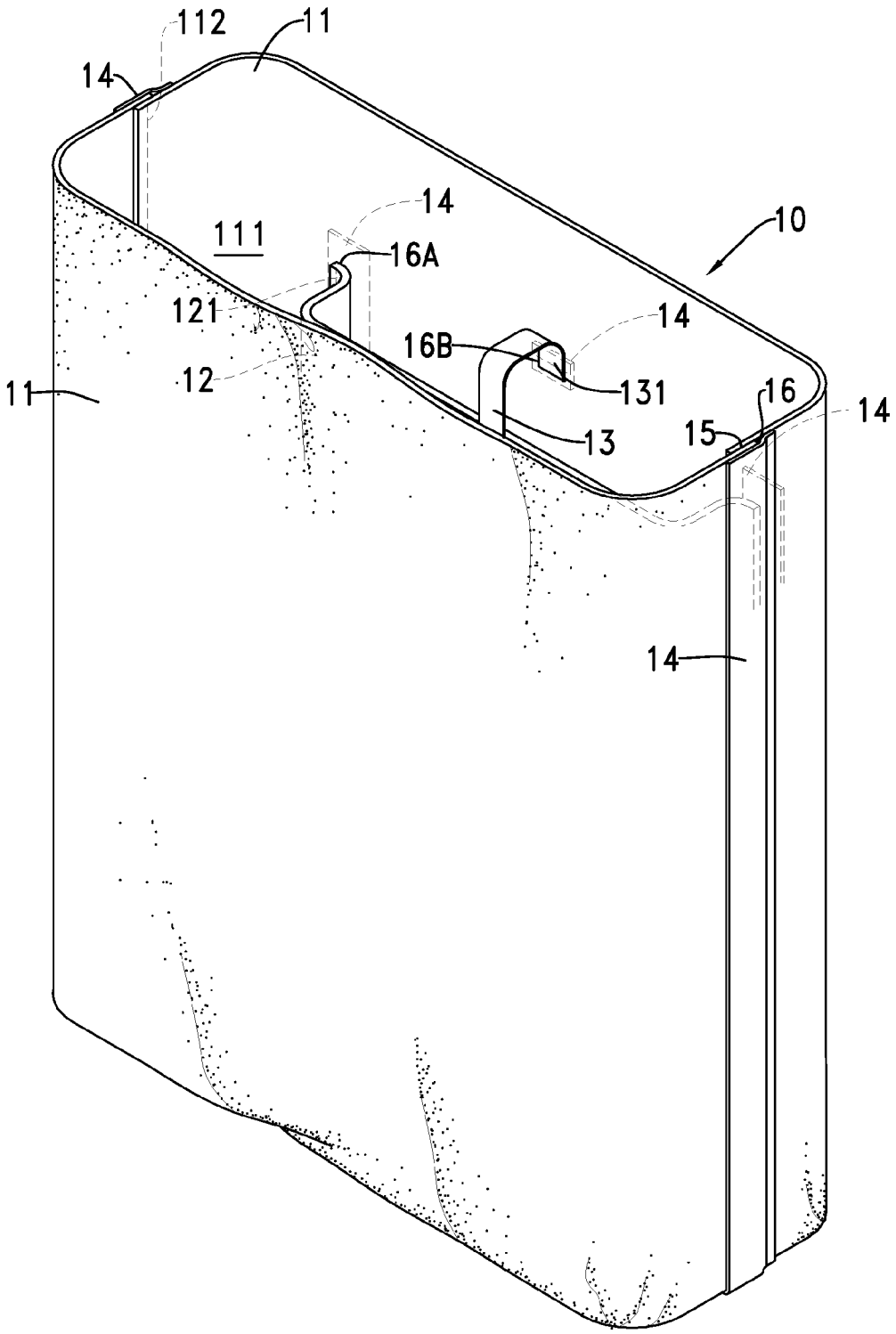
FIG. 1 is a perspective view of the inner lining in accordance with the present invention.

With reference to FIG. 1, an inner lining 10 in accordance with the present invention comprises: two waterproof fabrics 11, an inner pocket 12, a fixer 13, and multiple waterproof tapes 14.

Figure 2:
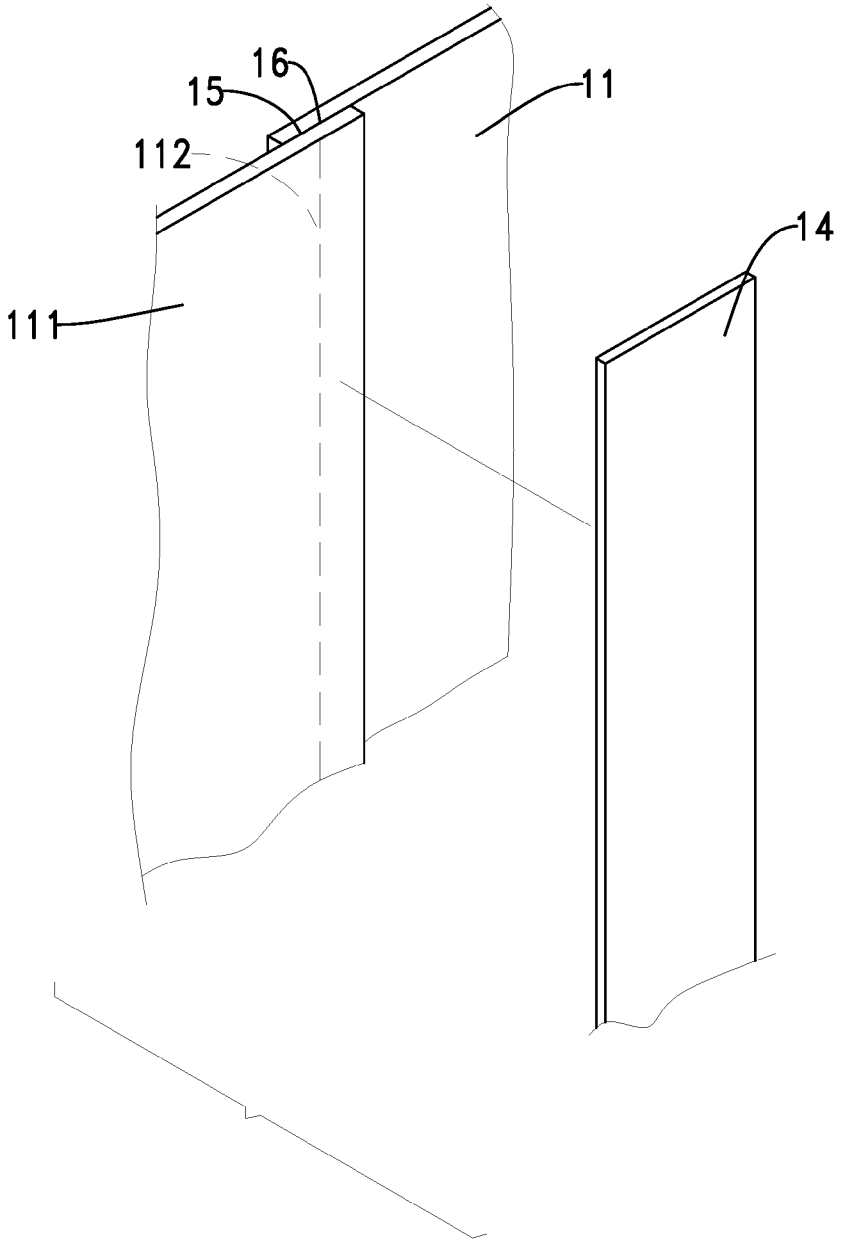
FIG. 2 is an operational view in accordance with the present invention, showing the waterproof tape covering the overlapping portion of the waterproof fabrics and the seam line.
Figure 3:
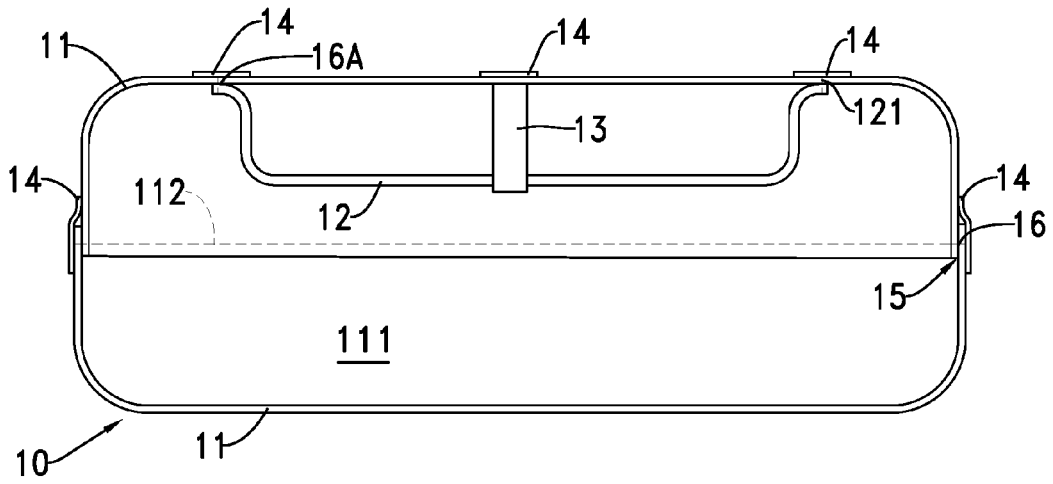
FIG. 3 is a top view of the inner lining in accordance with the present invention.

With reference to FIGS. 1 to 3, the two waterproof fabrics 11 are opposite each other. A receiving space 111 is formed by folding and stitching the above waterproof fabrics 11 relative to each other. The waterproof fabrics 11 are made of polymers such as Thermoplastic polyurethanes (TPU), Polyvinyl chloride (PVC), and Polycaprolactone (PCL). Items may be held in the receiving space 111.

There is an overlapping portion 15 around edges of the two waterproof fabrics 11. Multiple seam lines 112 are sewed on the overlapping portion 15, and the multiple seam lines 112 are interwoven between the two waterproof fabrics 11. The two waterproof fabrics 11 are fixed with each other by sewing. The multiple waterproof tapes 14 cover the multiple seam lines 112. The multiple waterproof tapes 14 are melted by high temperature about 400-600° C., and then the melting waterproof tapes 14 may have close adhesion on the exterior of the waterproof fabrics 11. Multiple gaps 16 between the overlapping portion 15 and the multiple seam lines 112 are covered and sealed by the multiple waterproof tapes 14. This design may prevent rainwater permeating into the receiving space 111 through the multiple gaps 16.

The inner pocket 12 is sewed on one of the two waterproof fabrics 11 within the receiving space 111. The inner pocket 12 has multiple pocket seam lines 121 around edges of the inner pocket 121. The multiple pocket seam lines 121 are interwoven between the waterproof fabrics 11 and the inner pocket 12. The multiple waterproof tapes 14 also cover the multiple pocket seam lines 121. Multiple gaps 16A between the waterproof fabrics 11 and the multiple pocket seam lines 121 are covered and sealed by the multiple waterproof tapes 14. This design may prevent the rainwater permeating into the inner pocket 12 through the multiple gaps 16A between the waterproof fabrics 11 and the multiple pocket seam lines 121.

The fixer 13 is a hook-and-loop fastener. The fixer 13 has two ends, one is sewed on the waterproof fabrics 11 within the receiving space 111 and the other one is selectively fixed with the inner pocket 12. The inner pocket 12 has an opening, and the opening may be selectively closed by the fixer 13. The fixer 13 has multiple fixing seam lines 131 between the waterproof fabrics 11 and the fixer 13. The multiple waterproof tapes 14 also cover the multiple fixing seam lines 131. Multiple gaps 16B between the waterproof fabrics 11 and the multiple fixing seam lines 131 are covered and sealed by the multiple waterproof tapes 14. This design may prevent rainwater permeating into the receiving space 111 through the multiple gaps 16B between the waterproof fabrics 11 and the multiple fixing seam lines 131. Furthermore, the fixer 13 also helps items to be held in the inner pocket 12 stably and safely.

Figure 4:
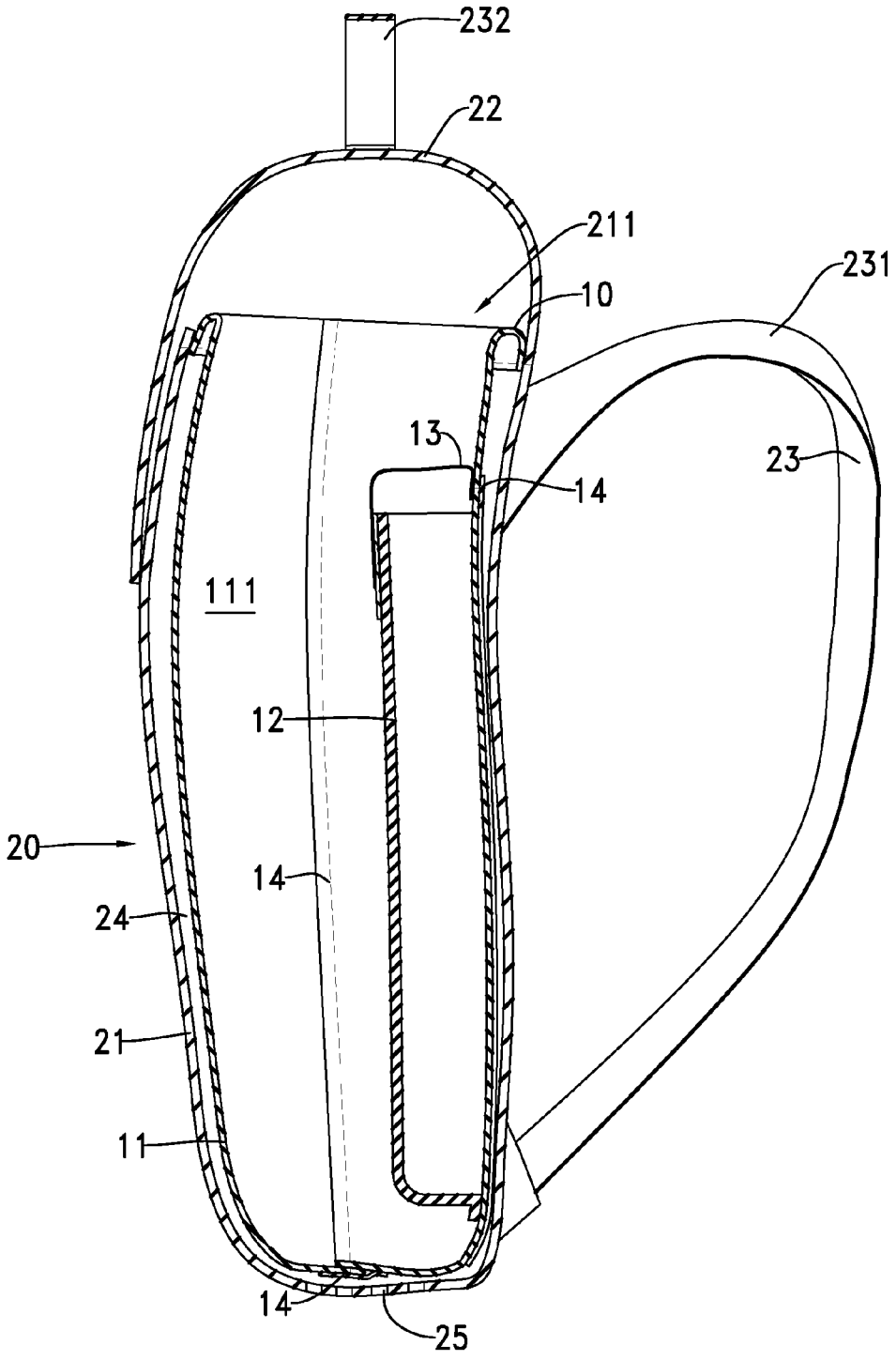
FIG. 4 is a cross-sectional view of the waterproof bag having the inner lining in accordance with the present invention.

The above inner lining 10 may be used in a waterproof bag 20. With reference to FIG. 4, the waterproof bag 20 having the inner lining 10 in accordance with the present invention comprises: an outer bag 21, a cap 22, and a portable device 23.

The outer bag 21 has an accommodating space 211. The inner lining 10 is mounted in the accommodating space 211. A top of the inner lining 10 is folded toward the outer bag 21. The top of the inner lining 10 and a top of the outer bag 21 are connected by sewing. An interval space 24 is formed between the inner lining 10 and the outer bag 21.

The cap 22 is connected to the top of the outer bag 21. The outer bag 21 and the cap 22 are integrated. The cap 22 may cover a connecting portion between the inner lining 10 and the outer bag 21, and the rainwater may not permeate into the interval space 24 through the connecting portion. In addition, the cap 22 may selectively close the receiving space 111 of the inner lining 10. The cap 22 stops the rainwater from falling into the receiving space 111 directly.

The portable device 23 is mounted on the outer bag 21. The portable device 23 is two shoulder straps 231 on the outer bag 21 and a hand strap 232 on the cap 22. Users may carry the waterproof bag 20 selectively over the shoulders or by hand.

Furthermore, multiple leaking holes 25 are formed on a bottom of the outer bag 21. The multiple leaking holes 25 connect the interval space 24 and an exterior of the outer bag 21. The rainwater will drain away to the exterior of the outer bag 21 through the multiple leaking holes 25 if the rainwater permeates into the interval space 24 accidentally. The interval space 24 may keep dry and avoid inducing mildews by moistures.

In summary, the multiple gaps 16, 16A, 16B around the multiple seam lines 112, the multiple pocket seam lines 121, and the multiple fixing seam lines 131 are covered and sealed by the multiple waterproof tapes 14. The inner lining 10 protects items from moisture damage in the receiving space 111 by the multiple waterproof tapes 14 covering the multiple seam lines 112, the multiple pocket seam lines 121, and the multiple fixing seam lines 131.

In addition, the inner lining 10 is sewed in the accommodating space 211 of an outer bag 21. A waterproof bag 20 is constructed by sewing the inner lining 10 and the outer bag 21. The waterproof bag 20 further has a cap 22. The cap 22 may cover the connecting portion between the inner lining 10 and the outer bag 21, and the rainwater may not permeate into the interval space 24 through the connecting portion. The cap 22 also may close the receiving space 111 and provide the protection to the items in the receiving space 111. Furthermore, the rainwater will drain away through the multiple leaking holes 25 if the rainwater permeates into the interval space 24 accidentally. The receiving space 111 and the interval space 24 may always keep dry. The inner lining 10 and the waterproof bag 20 having the inner lining 10 provide more convenience and safety in rainy days compared with the conventional waterproof bag cover.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. An inner lining comprising:

at least one waterproof fabric folded and stitched, and comprising:

a receiving space formed by the at least one waterproof fabric;

an overlapping portion formed around the at least one waterproof fabric;

at least one seam line sewed on the overlapping portion; and multiple gaps between the overlapping portion and the at least one seam line; and at least one waterproof tape covering the at least one seam line and sealing the multiple gaps;

an inner pocket sewed on the at least one waterproof fabric within the receiving space, the inner pocket having multiple pocket seam lines between the at least one waterproof fabric and the inner pocket, the at least one waterproof tape covering the multiple pocket seam lines; and a fixer sewed on the at least one waterproof fabric within the receiving space and selectively fixed with the inner pocket, the fixer having multiple fixing seam lines between the at least one waterproof fabric and the fixer, the at least one waterproof tape covering the multiple fixing seam lines.

2. A waterproof bag having an inner lining as claimed in claim 1 comprising:

an outer bag having an accommodating space; wherein the inner lining is sewed in the accommodating space;

a cap mounted to a top of the outer bag and selectively closing the accommodating space;

an interval space formed between the outer bag and the inner lining; and a portable device mounted on the outer bag; and at least one leaking hole formed on a bottom of the outer bag, the at least one leaking hole connecting the interval space and an exterior of the outer bag.

3. The waterproof bag having the inner lining as claimed in claim 2, wherein the portable device is a pair of shoulder straps or a hand strap.

4. The waterproof bag having the inner lining as claimed in claim 3, wherein the hand strap is mounted on the cap.

* * * * *